US011291598B2

(12) United States Patent
Sielski et al.

(10) Patent No.: US 11,291,598 B2
(45) Date of Patent: Apr. 5, 2022

(54) LIFT ESPECIALLY FOR CHANGING THE POSITION OF THE SEAT IN A WHEELCHAIR

(71) Applicant: REAC POLAND Sp. z o.o., Piotrkow Trybunalski (PL)

(72) Inventors: Zbigniew Sielski, Piotrkow Trybunalski (PL); Piotr Szylar, Piotrkow Trybunalski (PL)

( * ) Notice: Subject to any disclaimer, the term of this patent is extended or adjusted under 35 U.S.C. 154(b) by 260 days.

(21) Appl. No.: 16/683,569

(22) Filed: Nov. 14, 2019

(65) Prior Publication Data

US 2021/0069039 A1 Mar. 11, 2021

(30) Foreign Application Priority Data

Sep. 11, 2019 (PL) ..... 431023

(51) Int. Cl.
*A61G 5/10* (2006.01)

(52) U.S. Cl.
CPC ..... *A61G 5/1056* (2013.01); *A61G 2203/70* (2013.01)

(58) Field of Classification Search
CPC .. A61G 5/1056; A61G 5/1075; A61G 5/1059; A61G 2203/70
See application file for complete search history.

(56) References Cited

U.S. PATENT DOCUMENTS

| | | | | |
|---|---|---|---|---|
| 9,033,360 | B2 * | 5/2015 | Davis | A61G 5/1059 280/647 |
| 2006/0097477 | A1 * | 5/2006 | Le | A61G 5/1059 280/304.1 |
| 2019/0125599 | A1 * | 5/2019 | Mulhern | A61G 15/02 |

FOREIGN PATENT DOCUMENTS

| | | | | |
|---|---|---|---|---|
| PL | W125343 | | 1/2017 | |
| WO | 00/21478 | | 4/2000 | |
| WO | WO-2013066198 | A1 * | 5/2013 | A61G 5/1059 |

* cited by examiner

*Primary Examiner* — Minnah L Seoh
*Assistant Examiner* — Harold Eric Pahlck, III
(74) *Attorney, Agent, or Firm* — Myers Wolin, LLC

(57) ABSTRACT

A lift which is mainly used in wheelchairs to change the position of the seat and thus to change the position of a person sitting in the wheelchair. On the known scissor lift there is attached an upper frame consisting of a horizontal fixed part 1 and a tilting plate 2 attached to arms 3. In the fixed part 1 of the upper frame, tilting arms 5 are pivotally mounted on axle 4, with the other end pivotally mounted on axle 6 in arms 3 of the tilting plate 1, powered by the actuator 7 mounted in fixed part 1 of the upper frame. Actuator 7 through the levers of the cam tilting system drives tilting arms 5. The tilting plate 2 can be tilted in both directions around axle 6 that is around the attachment point of the arms 3 in the tilting arms 5.

2 Claims, 4 Drawing Sheets

LIFT ESPECIALLY FOR CHANGING THE POSITION OF THE SEAT IN A WHEELCHAIR

CROSS-REFERENCE TO RELATED APPLICATIONS

This application claims priority to Polish Application P.431023, filed Sep. 2, 2019, the entire contents of which are hereby incorporated by reference in their entirety.

FIELD OF THE INVENTION

The subject of the invention is a lift which is mainly used in wheelchairs to change the position of the seat and thus to change the position of a person sitting in the wheelchair.

BACKGROUND

From the patent specification WO2000021478 a lift is known for changing the position of the seat in wheelchairs in which the horizontal seat frame consists of a lower and an upper part. The lower part is rigidly connected to the wheelchair, while the upper part is movable, performs up-down movements. The movement of the upper frame is possible owing to the action of scissor lift arms which connect both frames. The scissor lift is powered by an electric actuator whose one end is pivotally mounted in the lower frame and the other end is mounted in one pair of arms. When the piston is extended the upper frame rises, when it is retracted—a return movement occurs. Both frames are always parallel to each other, the range of upward movement is regulated by the piston movement. When the piston is retracted the frames form a compact, flat block. The upper surface of the block is a soft proper seat, which is attached to the upper frame. From the description of the Polish utility model No. W.125343 a lift is known for changing the position of the seat in a wheelchair in which the upper frame of the lift consists of a horizontal fixed part and a movable part—a tilting plate mounted in the fixed part. A proper seat is attached to the tilting plate. The tilting plate of the upper frame of the lift is mounted pivotally and slidably at one end in a guide in the fixed part of the upper frame. In the upper frame there are also mounted tilting arms pivotally, with the other end pivotally mounted in the tilting plate (in the lateral arms of the tilting plate). In the fixed part of the upper frame there is an actuator acting through a cam tilting system on the tilting arms. The tilting system consists in a lever of the tilting system, permanently connected to the axle, to which cams of the tilting system are also permanently connected. The cams have recesses in which a pin is placed in the tilting arms.

BRIEF SUMMARY

The lift according to the invention is characterized in that the tilting plate of the upper frame is pivotable in both directions around the mounting axis of the tilting plate in the tilting arms. The tilting drive in both directions being the drive cylinder, mounted with one end in the fixed part of the upper frame, and the other end is mounted in the lever of the cam tilting system of the tilting arms.

In the lateral arms of the tilting plate there are control strips with front pins and rear pins at the ends, sliding longitudinally in the arms so that in one end position the rear pins of each control bar are locked in the rear hooks of the tilting arms, and in the other end position the front pins of each control bar are locked in the front hooks in the connectors, pivotally mounted in the arms of the tilting plate in the mounting axis of the tilting plate in the pivoting arms. The connectors at the other end, at the front hooks with pins guide, placed in guides of the fixed part of the upper frame.

The control strips are driven by a motor with a variable direction of rotation through a shaft with levers at the ends. One of the ends of the lever is connected to the shaft of the motor and the other end of the lever is connected to the sliding strips.

The lift according to the invention in the folded state is in the form of a thin, flat block, it is characterized by high universality, enables the person sitting in the wheelchair to perform more activities in relation to known solutions. A disabled person can adjust the height of the seat, he can also take a reclined position from the vertical, e.g. to allow the medical treatment, drip connection or just to increase comfort during rest. In turn, tilting forward allows, for example, to pull the wheelchair closer to the table because then the knees of a person in the wheelchair can be placed under the counter and it is easier to get up from the wheelchair. Such two-side change of the position of the seat, and thus change of the position of a person in a wheelchair, improves the comfort of life of a wheelchair user. Changing the position of the body prevents pressure sores, because by tilting the seat it is possible to change the direction of the forces acting on the body of a disabled person without having to move—the seat can be tilted up to 50° to one side or the other, so from a sitting position a person can be tilted to a semi-reclined or forward-leaning position.

BRIEF DESCRIPTION OF THE DRAWINGS

The subject of the invention is shown in the example of implementation in which.

DETAILED DESCRIPTION

Figure 1:
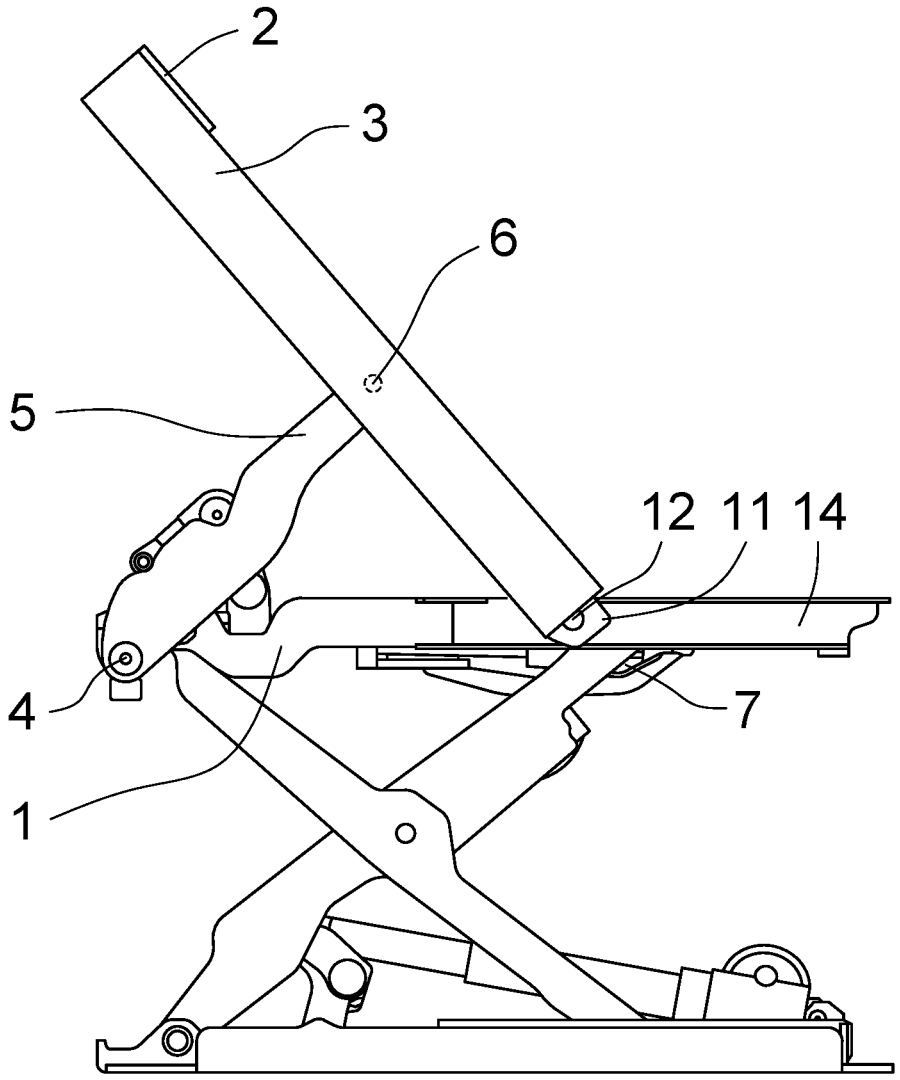
FIG. 1 shows a side view of the lift with the arms of the tilting plate of the upper frame tilted so that a person on the wheelchair is tilted backwards, in FIG. 2 the lift is shown in the same position but in axonometric view.
Figure 2:
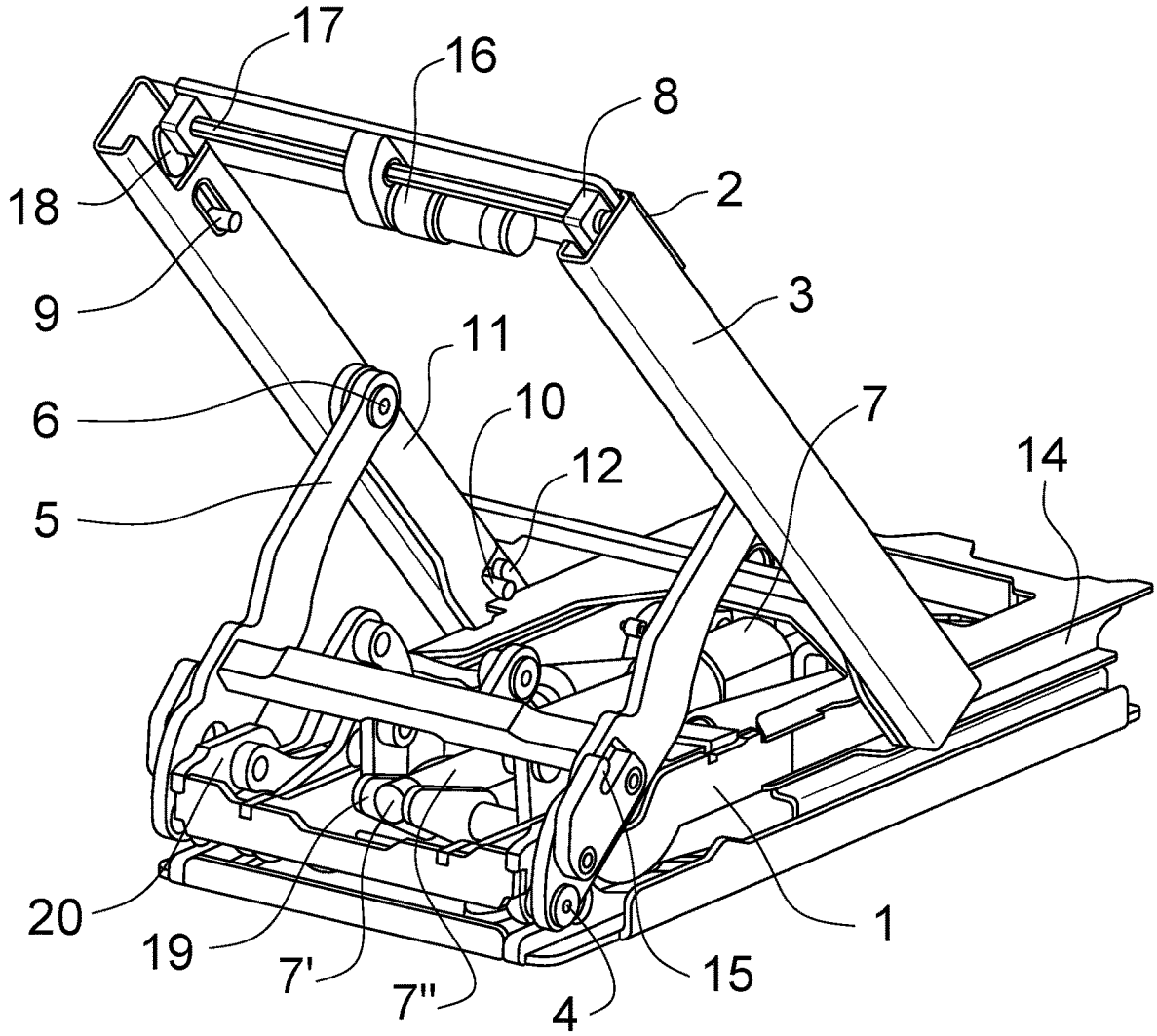
Figure 3:
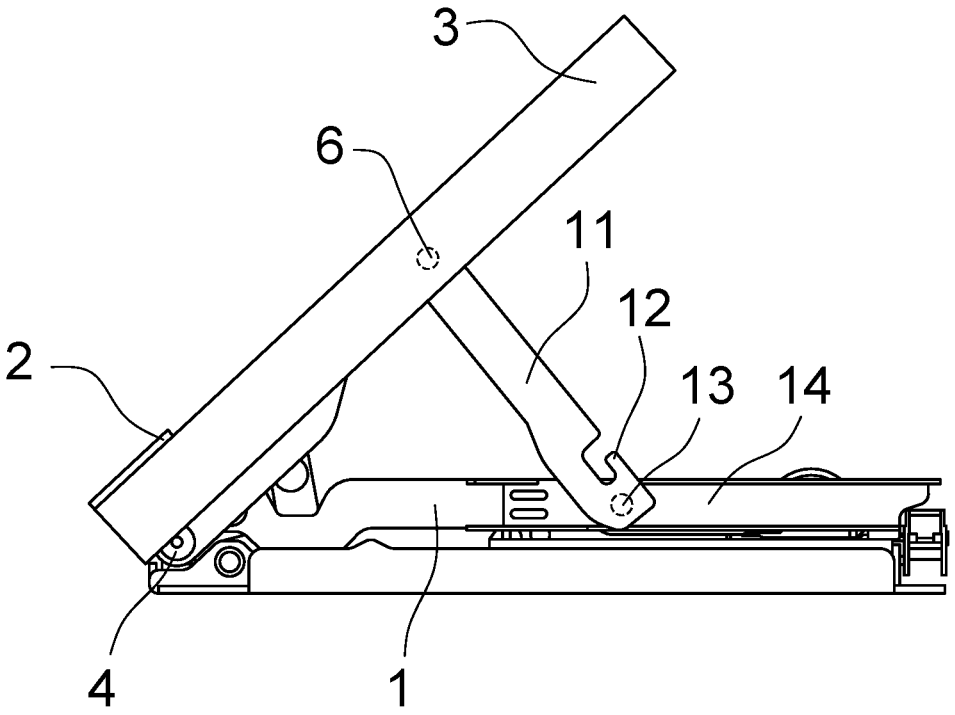
FIG. 3 shows a side view of the lift with a tilting plate which provides a forward tilt and FIG. 4 shows the lift in the same position but in an axonometric view, where the motor controlling the operation of the sliding strips is shown as well.
Figure 4:
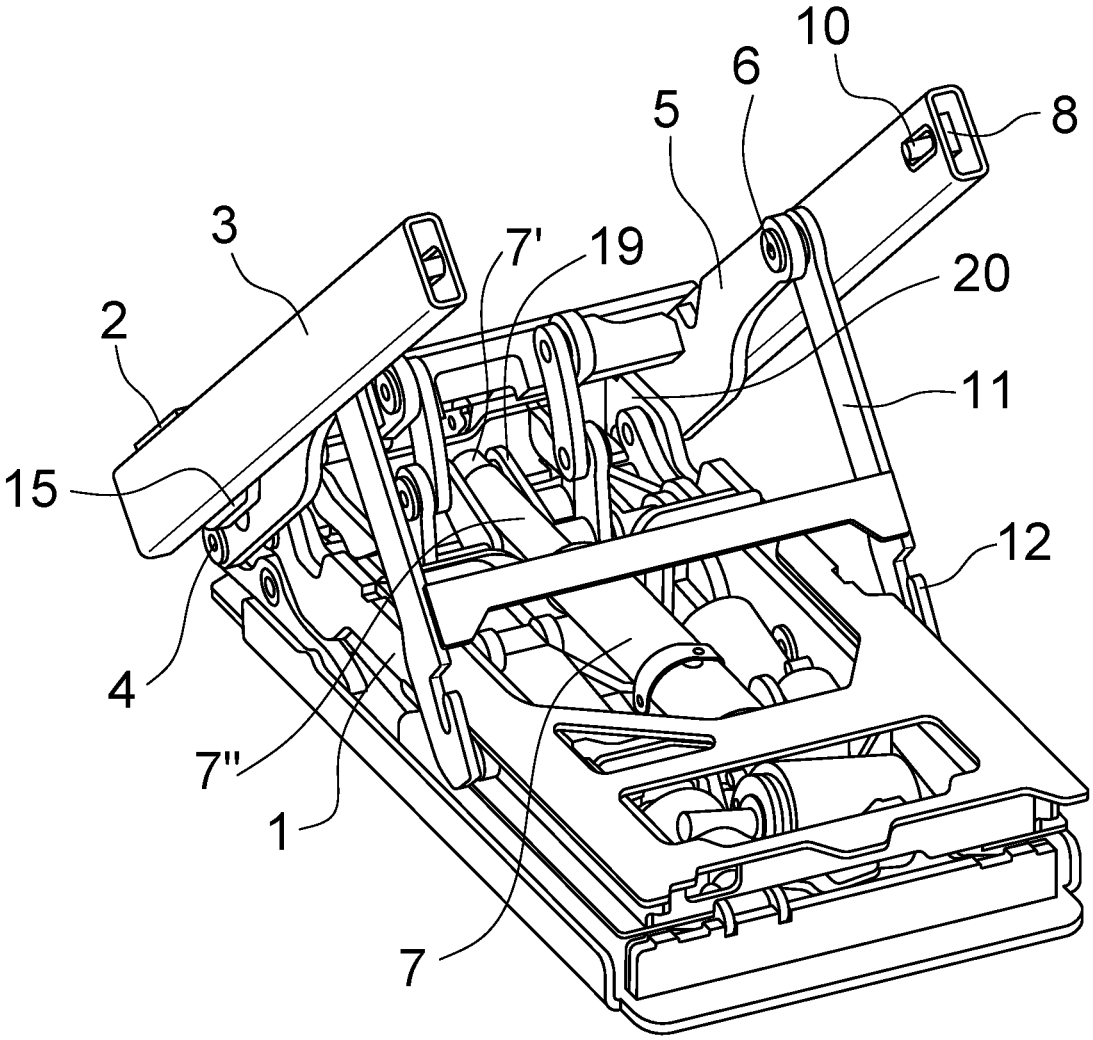

As shown in FIG. 1 on the known scissor lift there is attached an upper frame consisting of a horizontal fixed part 1 and a tilting plate 2 attached to arms 3. As shown in FIG. 2, FIG. 3 and FIG. 4 in the fixed part 1 of the upper frame, tilting arms 5 are pivotally mounted on axle 4, with the other end pivotally mounted on axle 6 in arms 3 of the tilting plate 1, powered by the actuator 7 mounted in fixed part 1 of the upper frame. Actuator 7 through the levers (19) of the cam tilting system (20) drives tilting arms 5. The tilting plate 2 can be tilted in both directions around axle 6 that is around the attachment point of the arms 3 in the tilting arms 5. In axle 6 the end of the connector 11 is also mounted, which has a guide pin 13 at the other end, placed in horizontal guides 14 of constant part 1. Near the guide pin 13, the connector 11 has a rear hook 12. The front hook 15 is attached to the tilting arms 5 near the rotation axle 4 of tilting arms 3 in fixed part 1. The tilting drive in both directions is the actuator 7 which is mounted with one end in the fixed part 1 of the upper frame and the other end (7') is mounted in the lever (19) of the cam tilting system (20) of the tilting arms 5. In arms 3 of the tilting plate 2 there are placed sliding control strip 8 with front 9 and rear pins 10 at the ends, longitudinally movable in arms 3 so that in one end position the rear pins 10 of each sliding control strip 8 are locked in the hooks 12 of the connector 11—then the tilting plate 2 is tilted backwards—backwards tilt is forced because the connectors 11 are locked with the arms 3 and the pin 13 moves in the guide 14—the front ends of the arms 3 rise because the front pins 9 do not bind the tilting arms 5 with the arms 3. In the second end position, pins 9 of each sliding control strip 8 are locked in the front hooks 15 in the tilting arms 5, so the extension of the piston rod 7" causes the tilting arms 5 mounted in the axles 4 together with the arms 3 locked with them to rotate around this axle 4 and then the rear ends of the arms 3 rise and the seat tilts forward. The sliding control strip 8 are powered by the motor 16 with a variable direction of rotation, through a shaft 17 with levers 18 at the ends, where one of the ends of the sliding control strip 8 is connected by the shaft 17 of the motor 16 and the other of the ends of the lever 18 is connected to the sliding control strip 8. Rotation of shaft 17 in one direction makes that the front pins 9 enter into the front hooks 15 (rear pins 10 disengage from the rear hooks 12) and forward tilting is realized and rotation of shaft 17 in other direction causes the front pins 9 to disengage from of the front hooks 15, the rear pins 10 cause the connectors 11 to lock with the arms 3 and backward tilting is realized.

When folded up, the lift is a thin block, and even with the seat raised high, it is stable. By changing the tilt angle, you can easily adjust the center of gravity of a patient—wheelchair system. The lift according to the invention may also have other industrial applications, e.g. in transport lines, in production lines.

The invention claimed is:

1. A lift for changing a position of a seat in a wheelchair in which an upper frame of the lift comprises a horizontal fixed part and a tilting plate, mounted on arms in the fixed part of the upper frame, where the seat is attached to the tilting plate, and in the fixed part of the upper frame tilting arms are pivotally mounted, with an other end of the ends of the tilting arms pivotally mounted in the arms of the tilting plate, powered by an actuator mounted in the fixed part of the upper frame, whereby the actuator drives the tilting arms through a lever of a cam tilting system, wherein the tilting plate (2) of the upper frame is pivotable in both directions around a mounting axis (6) of the tilting plate (2) in the tilting arms (5), a tilting drive in both directions being a drive cylinder (7), mounted with one end in the fixed part (1) of the upper frame, and an other end (7') is mounted in the lever (19) of the cam tilting system (20) of the tilting arms (5), wherein in the arms (3) of the tilting plate (2) there are sliding control strips (8) with front pins (9) and rear pins (10) at ends, sliding longitudinally in the arms (3) so that in one end position the rear pins (10) of each sliding control strip (8) are locked in rear hooks (15) of the tilting arms (5), and in the other end position the front pins (9) of each sliding control strip (8) are locked in front hooks (12) in connectors (11), pivotally mounted in the arms (3) of the tilting plate (2) in the mounting axis (6) of the tilting plate (2) in the tilting arms (5), which at the other end, at the front hooks (12), have a pins guide (13), placed in guides (14) of the fixed part (1) of the upper frame.

2. The lift according to claim 1, wherein the sliding control strips (8) are powered by a motor (16) with a variable direction of rotation through a shaft (17) with levers (18) at ends, where one of the ends of the lever (18) is connected to the shaft (17) of the motor (16) and the other end of the lever (18) is connected to the sliding control strips (8).

* * * * *